US007351075B1

(12) United States Patent
Patterson et al.

(10) Patent No.: US 7,351,075 B1
(45) Date of Patent: Apr. 1, 2008

(54) ELECTRIFIED CEILING FRAMEWORK CONNECTORS

(75) Inventors: Brian T. Patterson, Lewisberry, PA (US); Randy Marshall Manning, Lemoyne, PA (US); Jere W. Myers, Washington Boro, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 11/581,822

(22) Filed: Oct. 17, 2006

(51) Int. Cl.
*H01R 25/00* (2006.01)

(52) U.S. Cl. ..... 439/121

(58) Field of Classification Search ..... 439/110–122
See application file for complete search history.

(56) References Cited

U.S. PATENT DOCUMENTS

| | | | | | |
|---|---|---|---|---|---|
| 3,590,135 | A | | 6/1971 | Herbenar et al. | 174/49 |
| 3,649,741 | A | | 3/1972 | Fremont | 174/48 |
| 3,683,101 | A | | 8/1972 | Liberman | 174/49 |
| 3,725,568 | A | | 4/1973 | Stanley | 174/48 |
| 3,781,567 | A | | 12/1973 | Papsco | 307/147 |
| 3,919,457 | A | | 11/1975 | Steiner | 174/48 |
| 4,540,847 | A | | 9/1985 | Gardner | 174/48 |
| 4,585,294 | A | * | 4/1986 | Wolowicz et al. | 439/827 |
| 4,631,648 | A | | 12/1986 | Nilssen | 362/150 |
| 4,690,474 | A | * | 9/1987 | Smart et al. | 439/120 |
| 4,822,292 | A | | 4/1989 | Thayer et al. | 439/207 |
| 4,919,625 | A | | 4/1990 | Coutre | 439/118 |
| 5,154,509 | A | | 10/1992 | Wulfman et al. | 362/226 |
| 5,342,204 | A | * | 8/1994 | Och | 439/39 |
| 5,455,754 | A | | 10/1995 | Hoffner | 362/250 |
| 5,868,489 | A | | 2/1999 | Fuller et al. | 362/249 |
| 6,033,097 | A | | 3/2000 | Harwood | 362/404 |
| 6,190,198 | B1 | | 2/2001 | Ray | 439/532 |
| 6,485,333 | B1 | * | 11/2002 | Shinchi | 439/587 |
| 6,540,372 | B2 | | 4/2003 | Joseph | 362/147 |
| 6,540,373 | B2 | | 4/2003 | Bailey | 362/150 |
| 6,722,918 | B2 | | 4/2004 | McCoy | 439/533 |
| 6,764,196 | B2 | | 7/2004 | Bailey | 362/147 |
| 2002/0109984 | A1 | | 8/2002 | Bischel et al. | 362/150 |
| 2002/0141181 | A1 | | 10/2002 | Bailey | 362/150 |
| 2003/0021116 | A1 | | 1/2003 | Miller et al. | 362/249 |

FOREIGN PATENT DOCUMENTS

| | | |
|---|---|---|
| EP | 0 085 478 A2 | 8/1983 |
| EP | 0 322 203 A2 | 6/1989 |

* cited by examiner

*Primary Examiner*—Ross Gushi

(57) ABSTRACT

An electrical connector for use with an electrified ceiling framework having a conductive body with a first end and second end. The first end of the conductive body is arranged and disposed to provide selective electrical contact to a first conductive surface disposed adjacent to a ceiling framework. The first end also includes a conductive, mechanically biased member capable of maintaining physical contact with the first conductive surface. The second end includes a surface arranged and disposed to provide selective electrical contact to a device selected from the group consisting of a voltage source, a second conductive surface, an electrical device and combinations thereof. The conductive body provides electrical connectivity between the conductive surface and the device.

11 Claims, 19 Drawing Sheets

ELECTRIFIED CEILING FRAMEWORK CONNECTORS

FIELD OF THE INVENTION

The present invention is directed to connectors for making electrical connections between conductive elements.

BACKGROUND OF THE INVENTION

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which either a pair of wires carrying high voltage AC are routed to the device that has a self-contained ability to convert the AC power to a useful form of low voltage DC power or where a pair of wires are routed from a separate source of useful low voltage DC power. Increased versatility in placement and powering of low voltage DC products is desirable. Specifically, there is an increasing desire to have electrical functionality, such as power and signal transmission, in the ceiling environment without the drawbacks of known ceiling systems, including the drawback of discrete pair wiring from the voltage source.

A conventional ceiling grid framework includes main grid elements running the length of the ceiling with cross grid elements therebetween. The main and cross elements form the ceiling into a grid of polygonal opening into which function devices, such as ceiling tiles, light fixtures, speakers, motion detectors and the like can be inserted and supported. The grid framework and ceiling tile system may provide a visual barrier between the living or working space and the infrastructure systems mounted overhead.

Known systems that provide electrification to ceiling devices, such as lighting, utilize a means of routing discrete wires or cables, principally on an "as needed" point-to-point basis via conduits, cable trays and electrical junctions located in the plenum space above the ceiling grid framework. These known systems suffer from the drawback that the network of wires required occupy the limited space above the ceiling grid, and are difficult to service or reconfigure. Moreover, the techniques currently used are limited in that the electricity that is provided to the ceiling environment is not reasonably accessible from all directions relative to the ceiling plane. In other words, electricity can be easily accessed from the plenum, but not from areas within or below the plane of the grid framework Further, the electrical power levels that are typically available are not safe for those not trained, licensed and/or certified in the practice to work with.

What is needed is a ceiling system that provides electrical functionality to the ceiling grid framework and between framework segments that can be safely utilized from above, below and within the plane of the grid framework without the drawbacks of known ceiling systems. The present invention accomplishes these needs and provides additional advantages.

SUMMARY OF THE INVENTION

The present invention includes an electrical connector having a conductive body with a first end and second end for use with an electrified ceiling framework. The first end of the conductive body is arranged and disposed to provide selective electrical contact to a first conductive surface disposed adjacent to a ceiling framework. Selective electrical contact may include temporary, substantially permanent or permanent contact between conductive surfaces. The first end also includes a conductive, mechanically biased member capable of maintaining physical contact with the first conductive surface. The second end includes a surface arranged and disposed to provide selective electrical contact to a device selected from the group consisting of a voltage source, a second conductive surface, an electrical device and combinations thereof. The conductive body provides electrical connectivity between the conductive surface and the device.

Another aspect of the invention includes an electrified ceiling framework comprising a conductive surface. A connector is adjacent to at least a portion of the conductive surface. The connector includes a conductive body with a first end and second end. The first end of the conductive body is arranged and disposed to provide selective electrical contact to the conductive surface disposed adjacent to the ceiling framework or a second end of a second connector. The first end also includes a conductive, mechanically biased member capable of maintaining physical contact with the conductive surface. The second end includes a surface arranged and disposed to provide selective electrical contact to a device selected from the group consisting of a voltage source, an electrical device, a second conductive surface and combinations thereof. The conductive body provides electrical connectivity between the conductive surface and the device.

An advantage of the electrical connectors of the present invention is the suitable electrical contact achieved via the mechanical bias created by the geometry of the connector.

Another advantage of the electrical connectors of the present invention is the removal and/or penetration of dust, dirt and/or oxide that may be present on electrical conductors to be contacted.

Still another advantage of the electrical connectors of the present invention is the flexibility in locating conductive surfaces having positive and negative polarity in order to allow connection to a greater variety of low voltage devices.

Still another advantage of the electrical connectors of the present invention is the ease of installation, including installation of the connections into grid framework previously installed.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
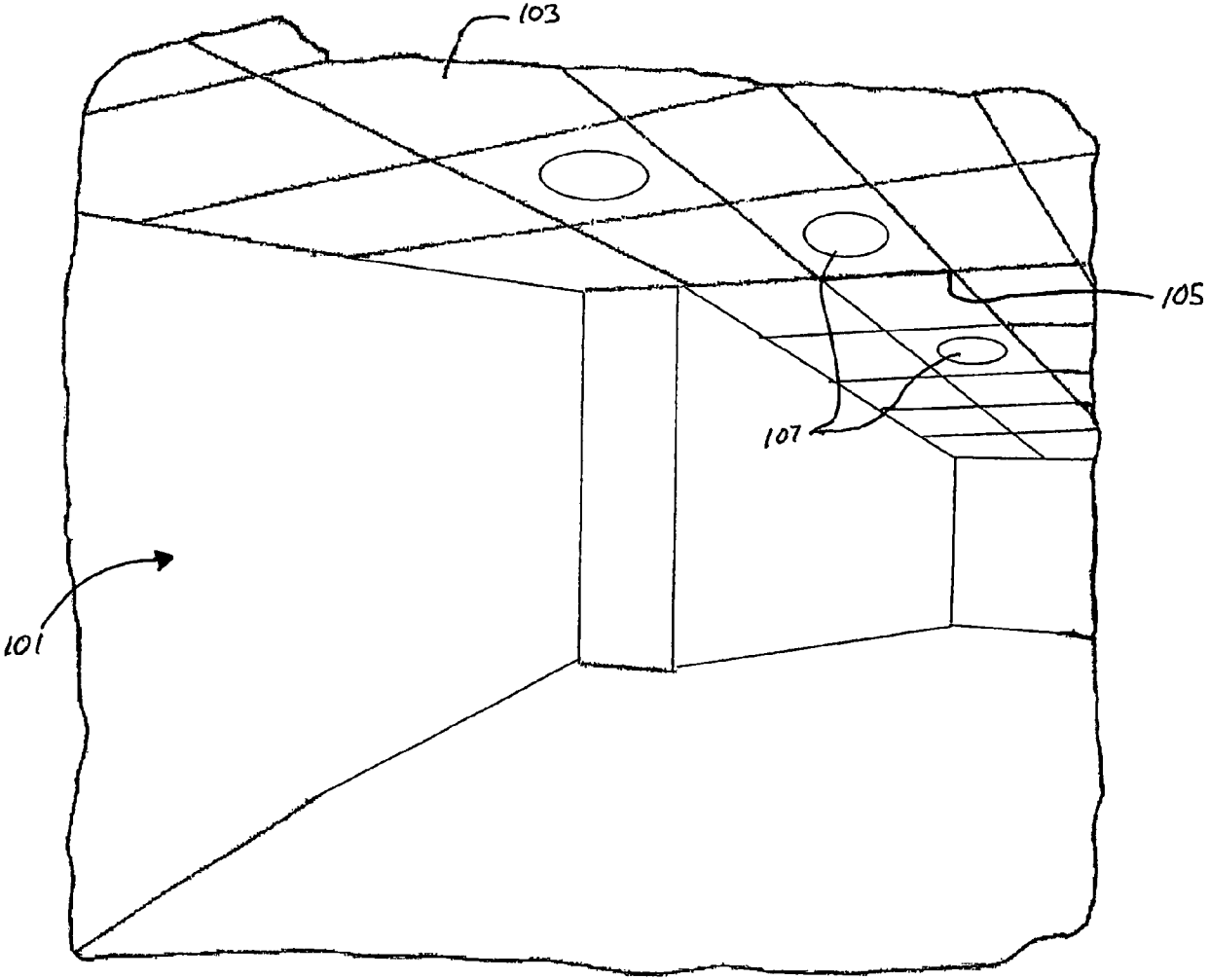
FIG. 1 shows a perspective view of a room space having an electrified ceiling according to an embodiment of the present invention.

The present invention includes connectors for use with an electrified ceiling. FIG. 1 shows a room space 101 having a ceiling 103 supported by a ceiling grid framework 105. The ceiling 103 may include decorative tiles, acoustical tiles, lights, heating ventilation and air conditioning (HVAC) vents, other ceiling elements or covers and combinations thereof. Low voltage devices 107, such as some light emitting diode (LED) lights, speakers, smoke or carbon monoxide detectors, wireless access points, still or video cameras, or other low voltage devices, may be mounted within ceiling 103. Power for the low voltage devices 107 is provided by conductors 201 (see FIG. 2) placed upon ceiling grid framework 105.

Figure 2:
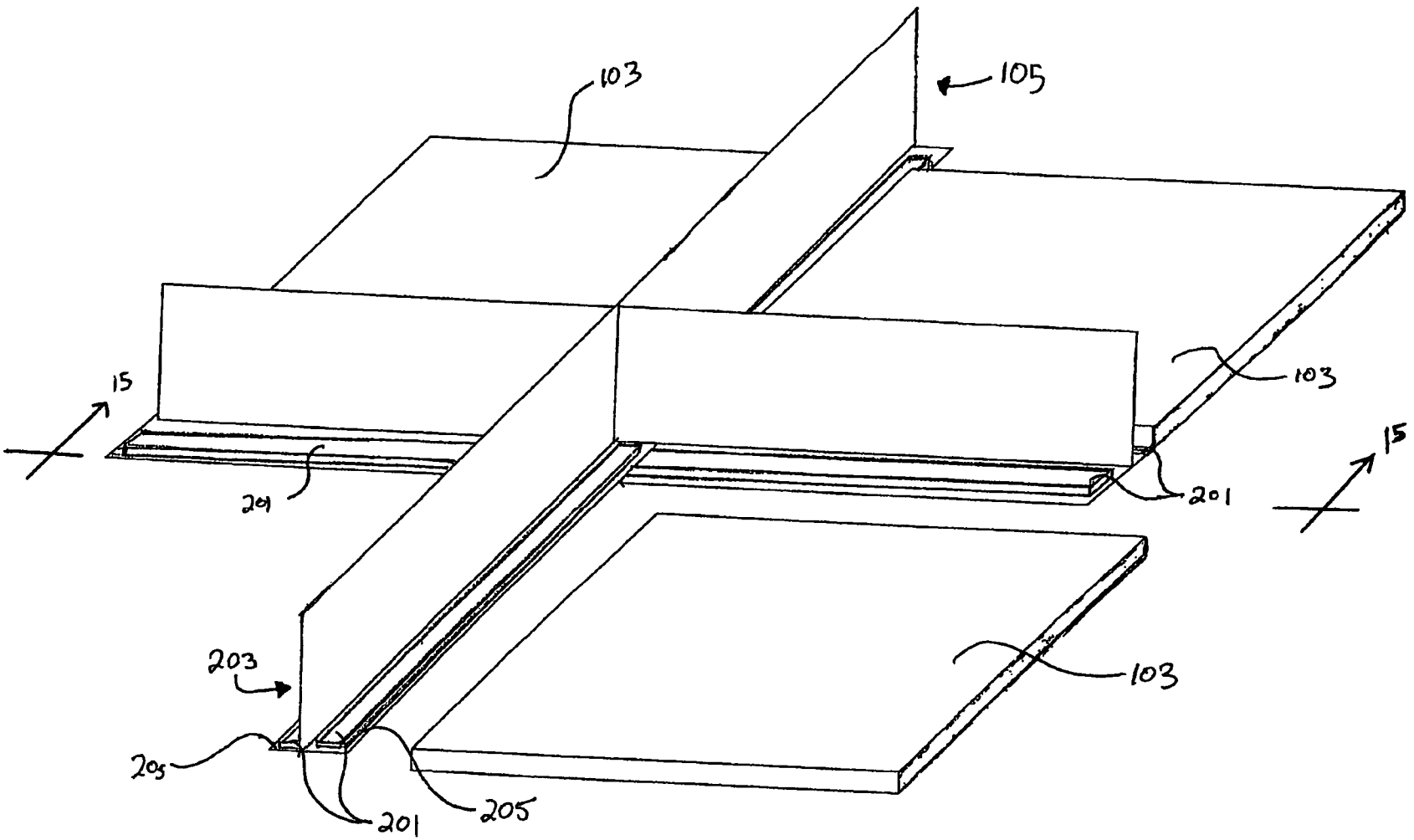
FIG. 2 shows a perspective view of a section of grid framework according to an embodiment of the invention.

FIG. 2 shows a perspective view of a segment of the ceiling grid framework 105 viewed from above with a portion of the ceiling 103 removed. The ceiling grid framework 105 includes a intersecting support member 203 having a cross-section having a substantially inverted "T" geometry. Although FIG. 2 shows an inverted "T" geometry, any geometry capable of supporting ceiling 103 may be used. In addition, support member 203 may include elongated box portions for supporting mechanical devices, such as partition doors, or conduit for wire (not shown in FIG. 2). The support members 203 are mounted to the building structure by use of mechanical wires or other suitable support devices connected to the building structure (not shown in FIG. 2).

Conductors 201 are mounted onto flange surfaces 205 of the ceiling grid framework 105. While the conductors 201 are shown mounted on flange surfaces 205, the conductors 201 may be mounted on any surfaces that may be electrically connected to electrical devices, including, but not limited to the vertical surfaces and lower flanges surfaces opposite the flange surfaces 205. The conductors 201 comprise a conductive material that, when contacted, provides sufficient power for a low voltage electrical device. Suitable conductive materials include, but are not limited to, aluminum and its alloys, copper and its alloys, brass, phosphor bronze, beryllium copper, stainless steel, or other conductive material or combinations thereof. In addition, conductive materials may include a conductive body material having a plating including, but not limited to, nickel, tin, lead, bismuth, silver, gold plating or other conductive material plating or combination thereof.

As shown in FIG. 2, suitable surfaces for receiving conductors 201 include two flange surfaces 205 of the support member 203, wherein one of the flange surfaces 205 receives a conductor 201 having a positive polarity and the second flange surface 205 receives a conductor 201 having a negative polarity. The conductors 201 may be exposed or may be partially or fully coated by an insulative or protective covering. The conductors 201 may run the entire length of the 205 surface or may run any portion of its length. The conductors 201 that are to have a positive polarity are electrically isolated from the conductors 201 that are to have a negative polarity. The conductors 201 may be mounted onto the ceiling grid framework 105 by any suitable method, including, but not limited to, adhesive or mechanical connection. In addition, the conductors 201 may be mounted directly onto the surface of the ceiling grid framework 105 or may have insulating material, such as MYLAR®, between the conductors 201 and the ceiling grid framework 105. MYLAR® is a federally registered trademark of E. I. Du Pont De Nemours and Company Corporation, Wilmington, Del., having a polyester composition that is well known in the art. Additional suitable insulative materials include, but are not limited to, polyester, acrylic, polyurethane, polyvinyl, silicone, epoxy, or other insulative compositions, or combinations thereof. Ceiling 103 may include conventionally available components, such as ceiling tiles that may be placed directly onto the conductors 201. In a preferred embodiment, the ceiling 103 includes ceiling tiles fabricated from an insulative material.

Figure 3:
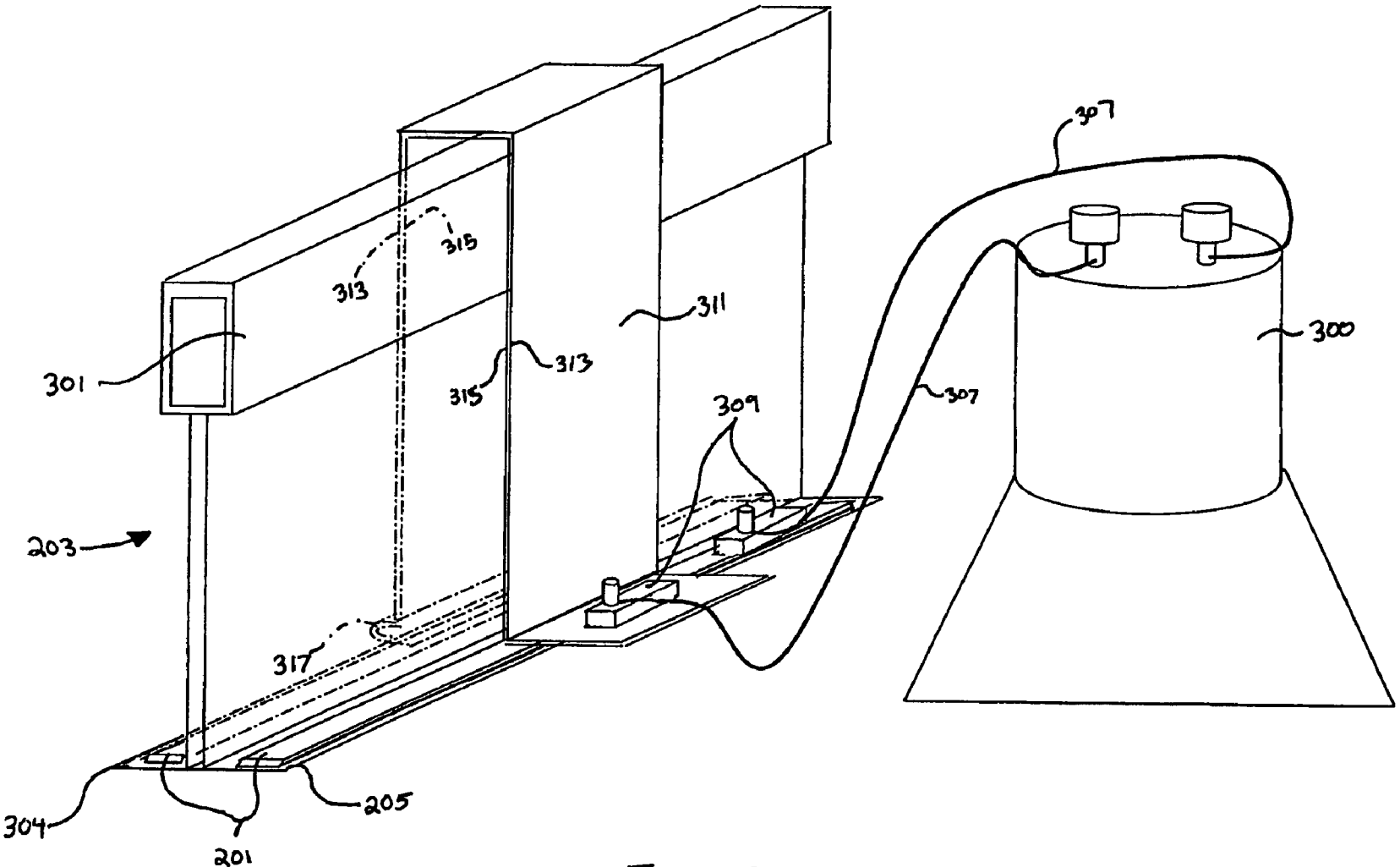
FIG. 3 shows a perspective view of a connector arrangement in connection with a low voltage device according to the present invention.

FIG. 3 shows perspective view of a portion of a support member 203 having an alternate geometry to the support member 203 shown in FIG. 2 electrically connected to an electrical device 300. The support member 203 in FIG. 3 includes an upper box or bulb 301 and a flange 304, which includes lower flange surfaces 205. Electrical device 300 is powered by a pair of wires 307 in electrical contact with conductors 201 by way of component connectors 309 and support connector 311. Support connector 311 includes a conductive outer surface 313 and an insulative inner surface 315. The outer surface 313 may include a conductive material, including but not limited to, aluminum, copper, brass, phosphor bronze, beryllium copper, stainless steel, or other conductive material or combinations thereof. In addition, conductive materials may include a conductive body material having a plating including, but not limited to, nickel, tin, lead, bismuth, silver, gold plating or other conductive material plating or combination thereof. The inner surface 315 may include an insulative material such as MYLAR®. Additional suitable insulative materials include, but are not limited to, polyester, acrylic, polyurethane, polyvinyl, silicone, epoxy, or other insulative compositions, or combinations thereof.

Support connector 311 includes a mechanically biased contact member 317. By mechanically biased, it is meant that the contact member 317 is configured to provide continuous physical contact between the outer surface 313 of support connector 311 and conductor 201 via elasticity of the material, material memory, by weight of the support connector 311, or by any other force providing means in order to contact and retain contact with the conductor 201. Component connectors 309 provide an electrical connection via a physical contact between a conductive member in electrical connection with wire 307 and either or both of conductor 201 and the conductive outer surface 313 of support connector 311. The component connector 309 may include any connector capable of providing electrical contact between the outer surface 313 and wire 307 and may include clips, plugs, screws solder or any other electrical connection (see also FIGS. 18-22).

Figure 4:
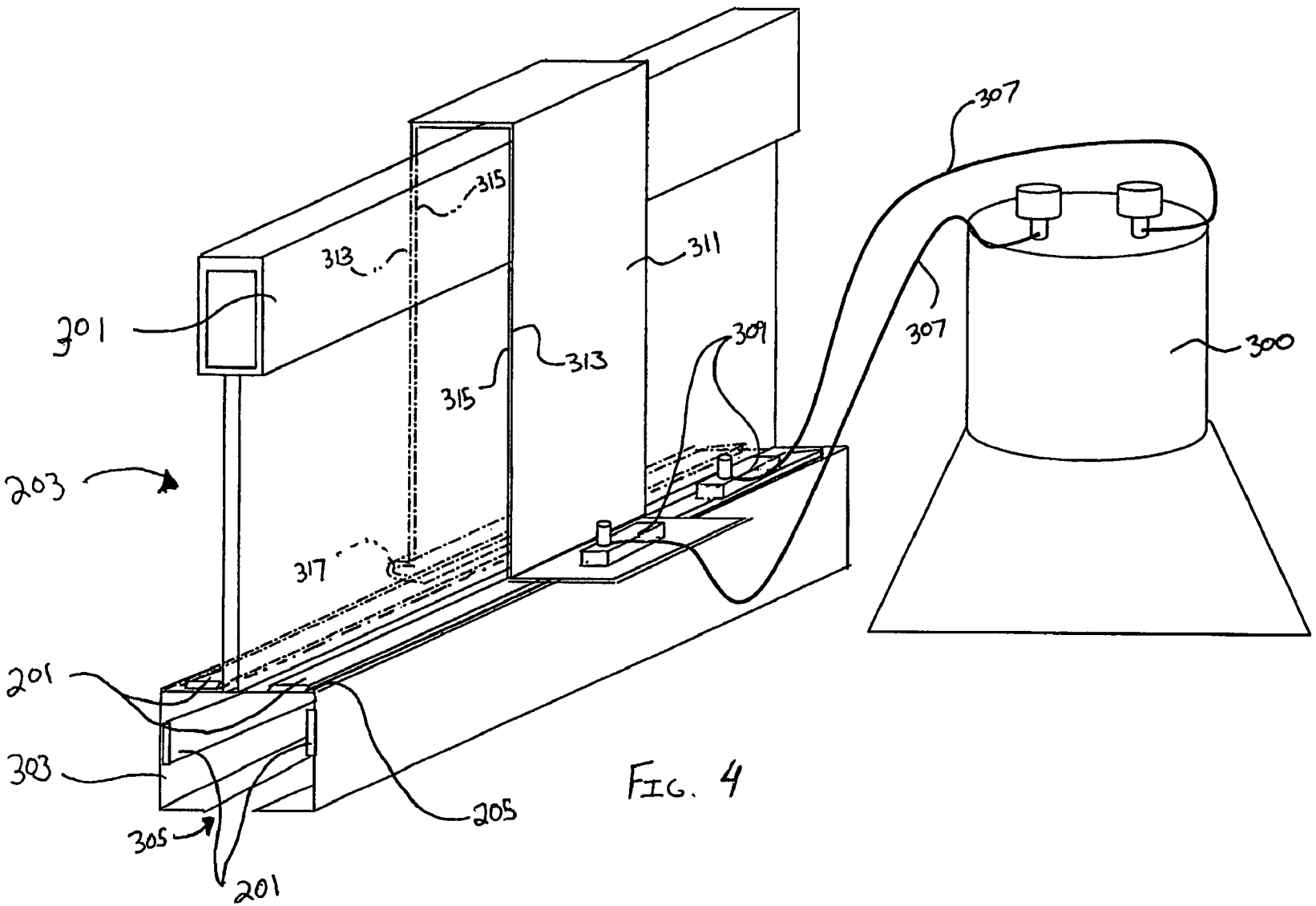
FIG. 4 shows a perspective view of a connector arrangement in connection with a low voltage device according to the present invention.

FIG. 4 shows perspective view of a portion of a support member 203 having an alternate geometry to the support member 203 shown in FIG. 3 electrically connected to an electrical device 300. As in the support member 203 in FIG. 3, the support member 203 includes a bulb 301 and lower flange surfaces 205. In addition, the support member 203 includes a lower box 303. The lower box 303 includes an opening 305 and additional surfaces onto which conductors 201 may be mounted. Although FIG. 4 shows two conductors in lower box 303 along the vertical walls, additional conductors 201 may be present and may be mounted on any of the surfaces within or on the exterior of lower box 303. Although FIG. 4 shows the electrical connection to the electrical device being provided by the conductors 201 disposed on the lower flange 205, the electrical connection may take place using any combination of connectors that complete an electrical circuit to power electrical device 300. For example, the electrical device 300 may be connected to conductor 201 having a positive polarity on lower flange surface 205 and a conductor having a negative polarity in lower box 303.

Figure 5:
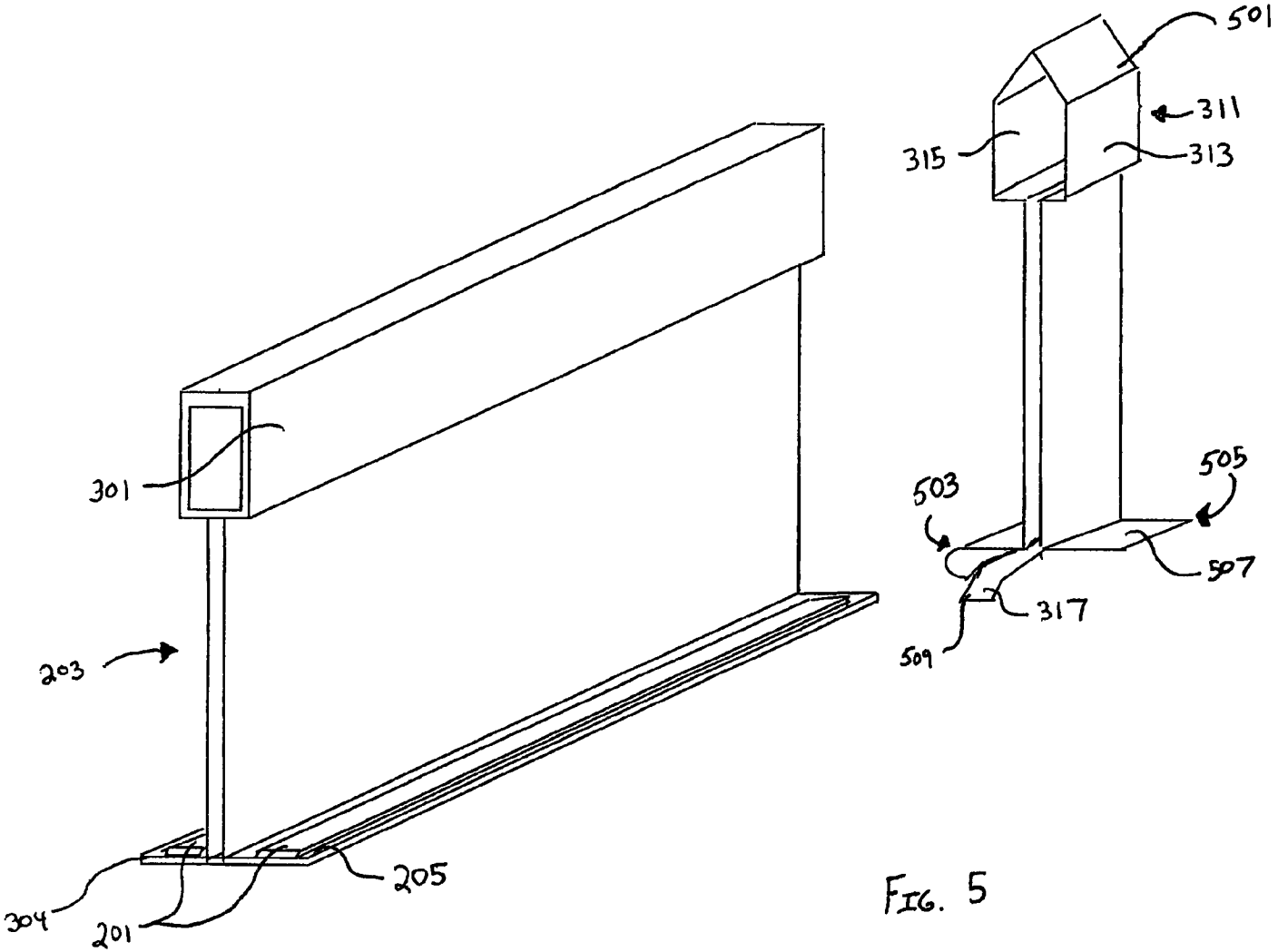
FIG. 5 shows a perspective view of a support member and connector for installation thereon according to the present invention.

FIG. 5 shows a support connector 311 and support member 203 according to an embodiment of the present invention. The support member 203 includes a bulb 301, a lower flange surface 205 and conductors 201. Although the support member 203 is shown in connection with support connector 311 and includes a single lower flange surface 205, the support connectors 311 may be utilized with any geometry of support member having conductors 201 on opposite sides of the support member 203, such as the geometry having a lower box 303, as in FIG. 4. The support connector 311 includes an outer conductive surface 313 and an inner insulative surface 315, as described above with respect to FIG. 3. The support connector 311 also includes a contact member 317. The contact member 317 is mechanically biased to provide force upon conductors 201 when installed upon support member 203. The support connector 311 further includes an upper portion 501 having a geometry configured to conform to the bulb 301 in a manner that may provide a force to the contact member 317 to maintain electrical contact with the conductor 201.

In addition, the support connector 311 has a first end 503 and a second end 505. The first end 503 of support connector 311 includes contact member 317. The second end 505 includes a second end surface 507 onto which electrical connections may be made. The support connector 311 is configured to permit separation of the first end 503 and the second end 505 in a manner allowing installation of the support connector 311 over the bulb 301 of the support member 203. In a preferred embodiment, the support connector 311 utilizes a shaped brass conductive outer surface 313 with a MYLAR® insulative coating on the inner surface 315, wherein the brass material has mechanical properties that provide a clipping or clamping force around bulb 301 to hold the support connector 311 in position and to aid in maintaining contact between the contact member 317 and the conductor 201, but is sufficiently pliable to permit separation of first end 503 and second end 505, which permits installation of the connector from above the support member 203. The contact member 317 includes a geometry that contacts the conductor 201 with sufficient force and at an angle such that the contact member 317 penetrates any dirt, dust, or oxide that may be present on the surface of the conductor 201. In a preferred embodiment, the contact member 317 includes a protrusion 509 that provides a lateral motion, such as a wiping motion, along the surface of the conductor 201 to further facilitate penetration of any dirt, dust or oxide on the surface of the conductor and to provide sufficient electrical contact between the contact member 317 and the conductor 201.

As shown in FIG. 5, the contact member 317 of this embodiment of the invention includes a U-shaped geometry terminating at a tabular protrusion 509 angled downward. The U-shape and the angle of the protrusion 509 act as a spring to provide mechanical bias on the conductor 201 when installed onto the support member 203. The protrusion 509 may include a singular protrusion or a plurality of protrusions oriented at similar or different angles and/or directions. The elasticity of the material of contact member 317 provides the mechanical bias and allows the contact member 317 to maintain physical contact with the conductor 201. The clipping or clamping action of the upper portion 501 of the support connector 311 may further assist in providing mechanical bias against the conductor 201.

Figure 6:
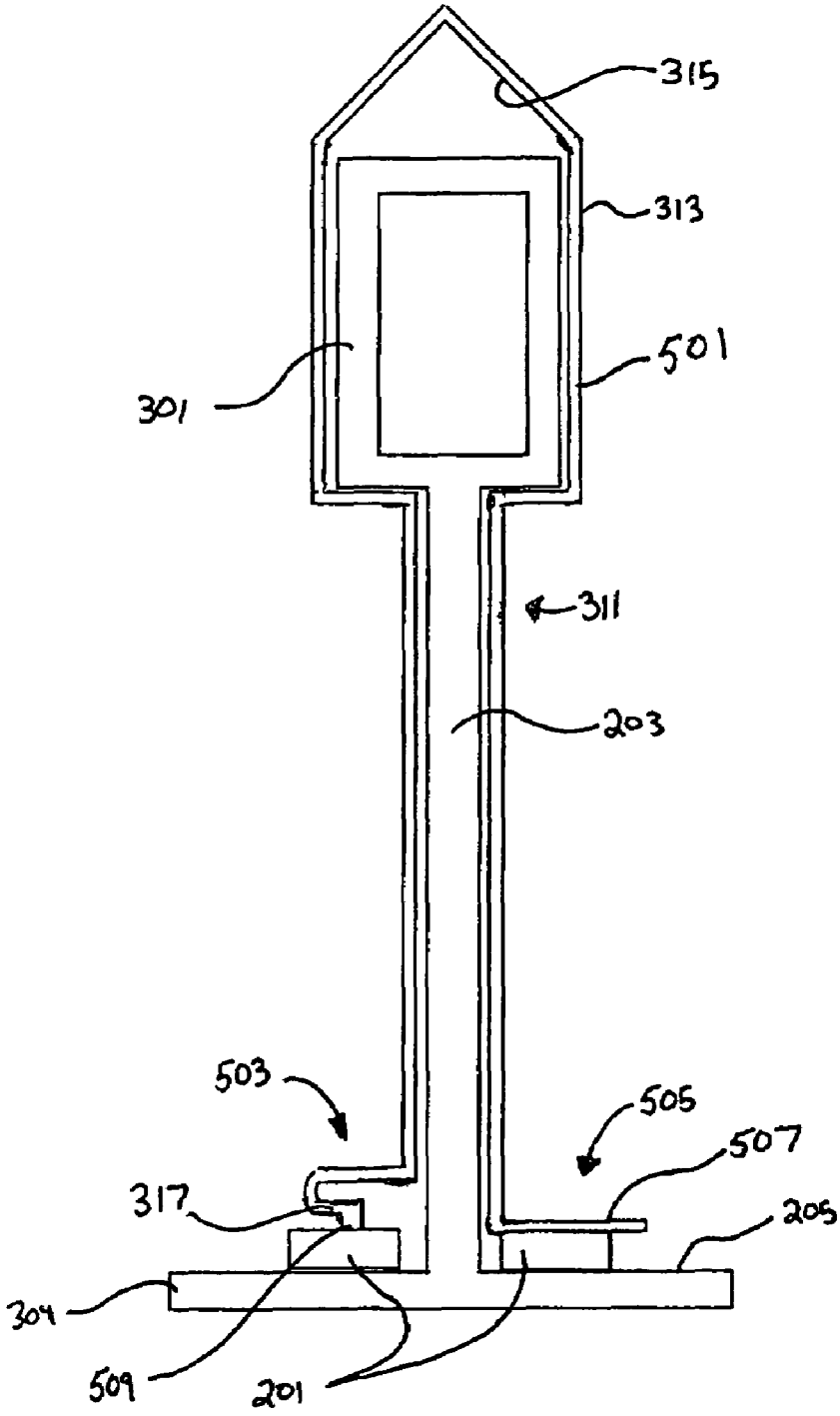
FIG. 6 shows an end elevational view of a support member and connector for installation thereon according to the present invention.

FIG. 6 shows an end elevational view of the support connector shown in FIG. 5 installed on the support member 203. As shown, the upper portion 501 conforms to the geometry of bulb 301 and retains the support connector 311 in place. The first end 503 includes contact member 317 which is in contact with conductor 201. The second end 505 includes second end surface 507, which provides a surface that is preferably substantially planar and oriented in a horizontal direction to provide a surface that is connectable with the assistance of gravity. However, electrical connections may be placed along any location on the conductive surface of the support connector 311. The insulative inner surface 315 permits the second side to rest upon the surfaces of the support member 203 and the conductor on the second end 505 without making electrical contact. The connection of the support connector 317 to conductor 201 permits the support connector 317 to provide an electrical connection between conductor 201 adjacent to the first end 503 to the end surface 507 at the second end 505.

Figure 7:
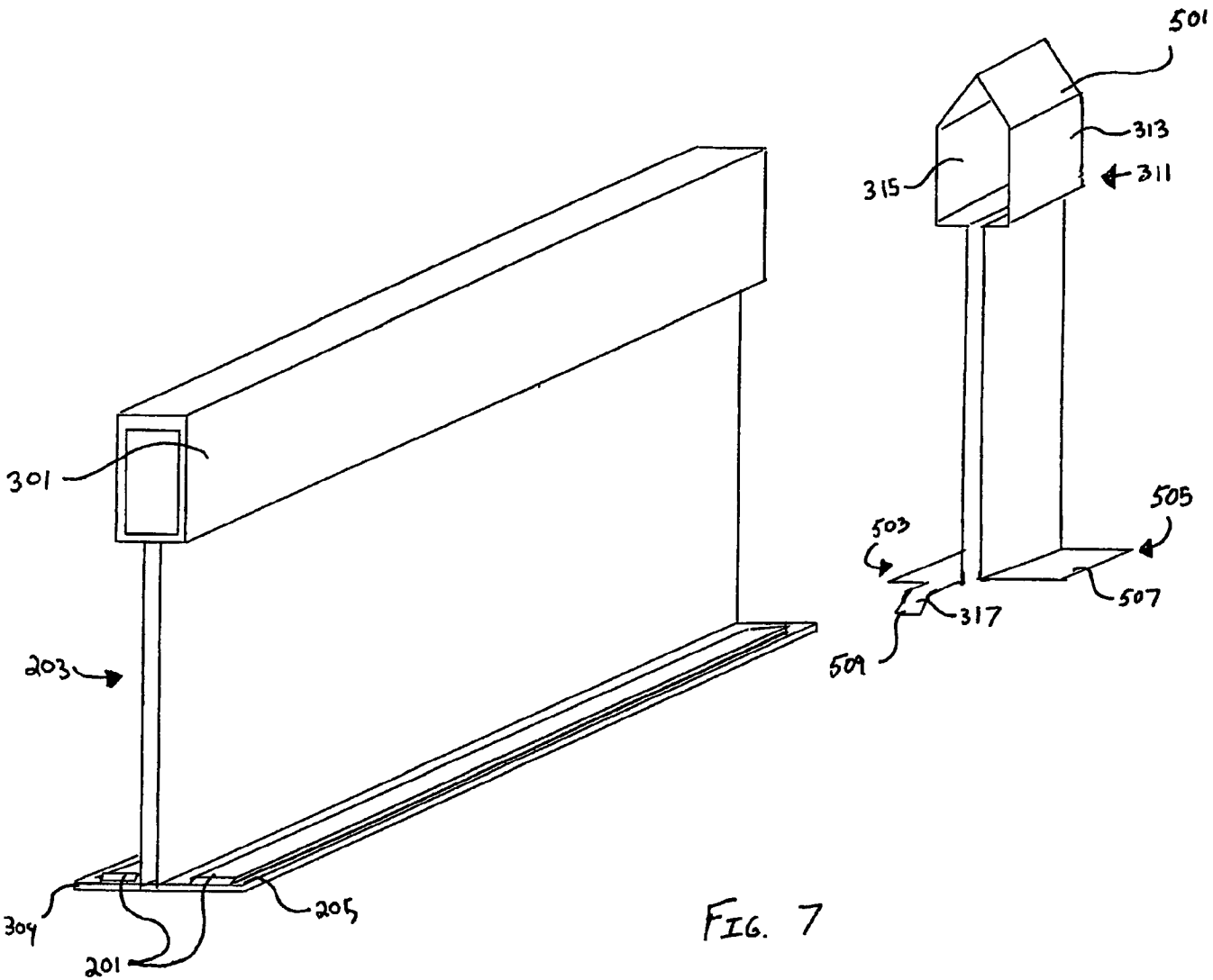
FIG. 7 shows a perspective view of an alternate embodiment of support member and connector for installation thereon according to the present invention.

FIG. 7 shows a support connector 311 and support member 203 according to an alternate embodiment of the present invention. The support member 203 and support connector 311 includes the same arrangement of bulb 301, a lower flange surface 205 and conductors 201, outer surface 313, inner surface 315, upper portion 501 and second end 505 as shown and described above with respect to FIG. 5. However, the contact member 317 includes a geometry having an angled protrusion 509 extending from the first end 503 of the support connector 311. The protrusion 509 is configured to act as a spring to provide mechanical bias on the conductor 201 when installed onto the support member 203. The elasticity of the material of contact member 317 provides the mechanical bias and allows the contact member 317 to maintain physical contact with the conductor 201. In addition, the geometry preferably provides lateral motion, such as a wiping motion, along the surface of the conductor 201 to further facilitate penetration of any dirt, dust or oxide on the surface of the conductor 201 and to provide sufficient electrical contact between the contact member 317 and the conductor 201. The clipping or clamping action of the upper portion 501 of the support connector 311 may further assist in providing mechanical bias against the conductor 201.

Figure 8:
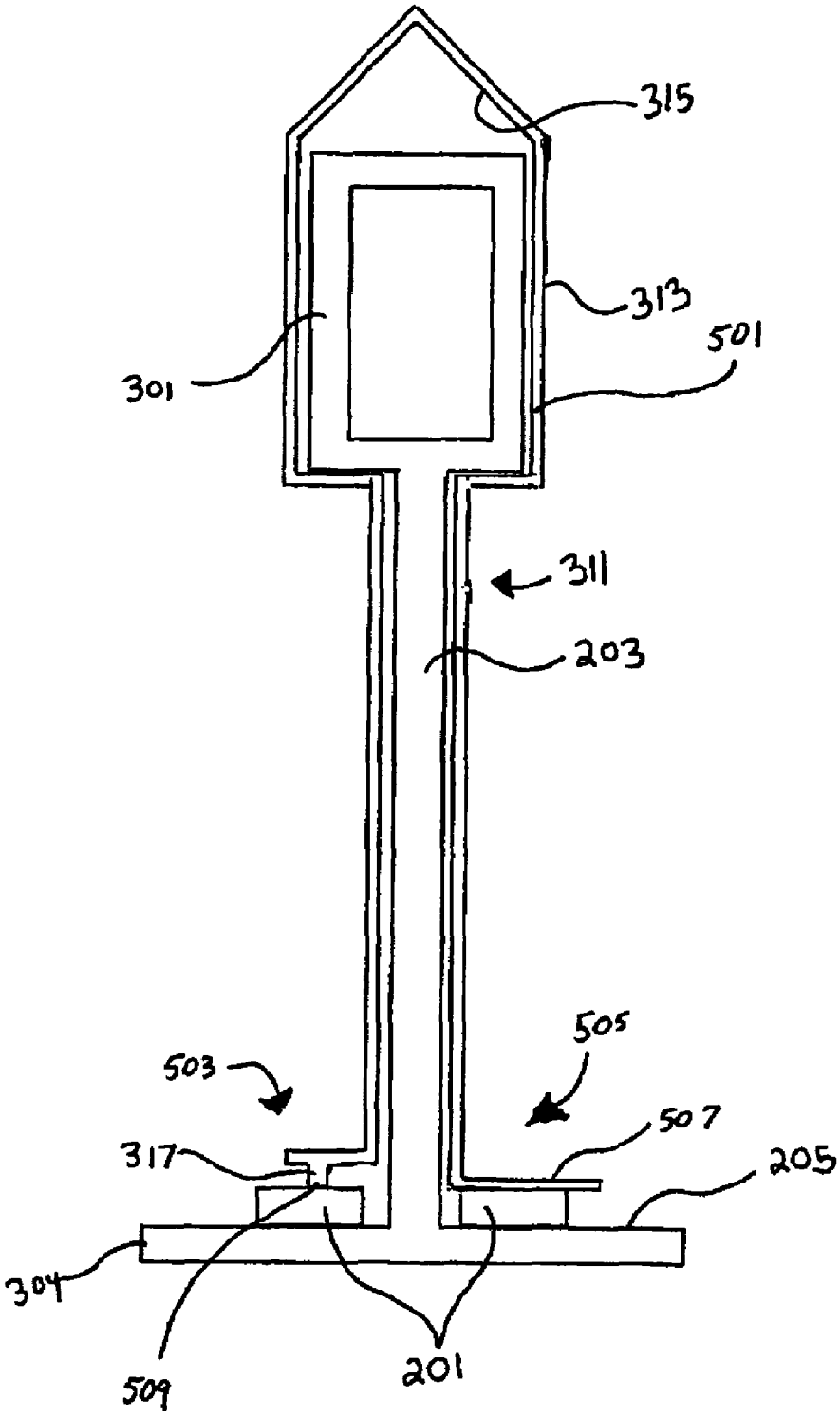
FIG. 8 shows an end elevational view of an alternate embodiment of a support member and connector for installation thereon according to the present invention.

FIG. 8 shows an end elevational view of the support connector 311 shown in FIG. 7 installed on the support member 203. FIG. 8 includes the same arrangement bulb 301, a lower flange surface 205 and conductors 201, outer surface 313, inner surface 315, upper portion 501 and second end 505 as shown and described above with respect to FIG. 6. However, as described with respect to FIG. 7, above, the protrusion 509 is angled from a portion of the first end 503 toward and in contact with conductor 201. The connection of the support connector 317 to conductor 201 permits the support connector 317 to provide an electrical connection between conductor 201 adjacent to the first side 503 to the end surface 507 at the second end 505.

Figure 9:
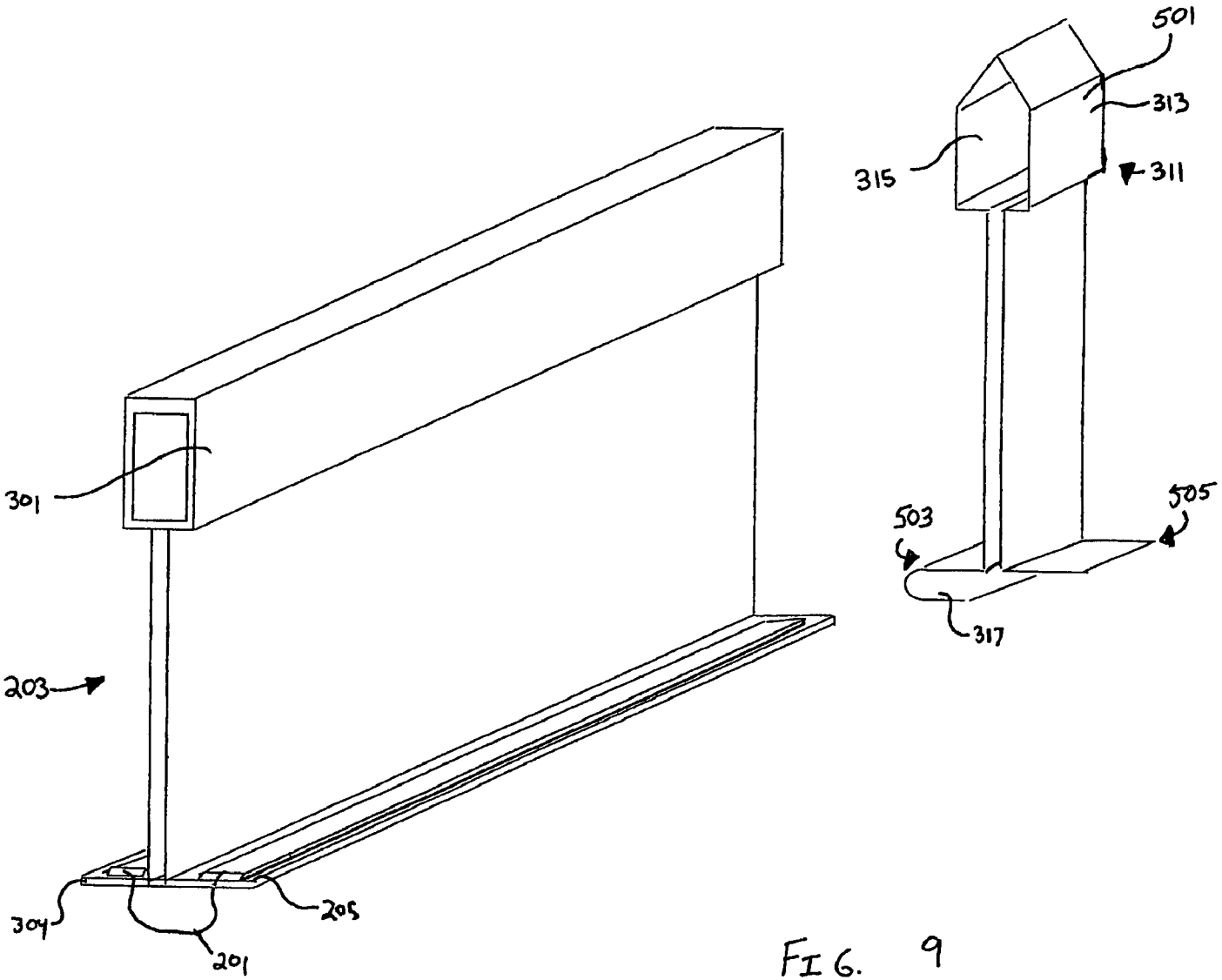
FIG. 9 shows a perspective view of another embodiment of support member and connector for installation thereon according to the present invention.

FIG. 9 shows a support connector 311 and support member 203 according to an alternate embodiment of the present invention. The support member 203 and support connector 311 includes the same arrangement of bulb 301, a lower flange surface 205 and conductors 201, outer surface 313, inner surface 315, upper portion 501 and second end 505 as shown and described above with respect to FIG. 5. However, the U-shaped support connector includes a geometry having a U-shaped contact member 317 forming the first end 503 of the support connector 311. The U-contact member 317 is configured to act as a spring to provide mechanical bias on the conductor 201 when installed onto the support member 203. The elasticity of the material of contact member 317 provides the mechanical bias and allows the contact member 317 to maintain physical contact with the conductor 201. The clipping or clamping action of the upper portion 501 of the support connector 311 may further assist in providing mechanical bias against the conductor 201.

Figure 10:
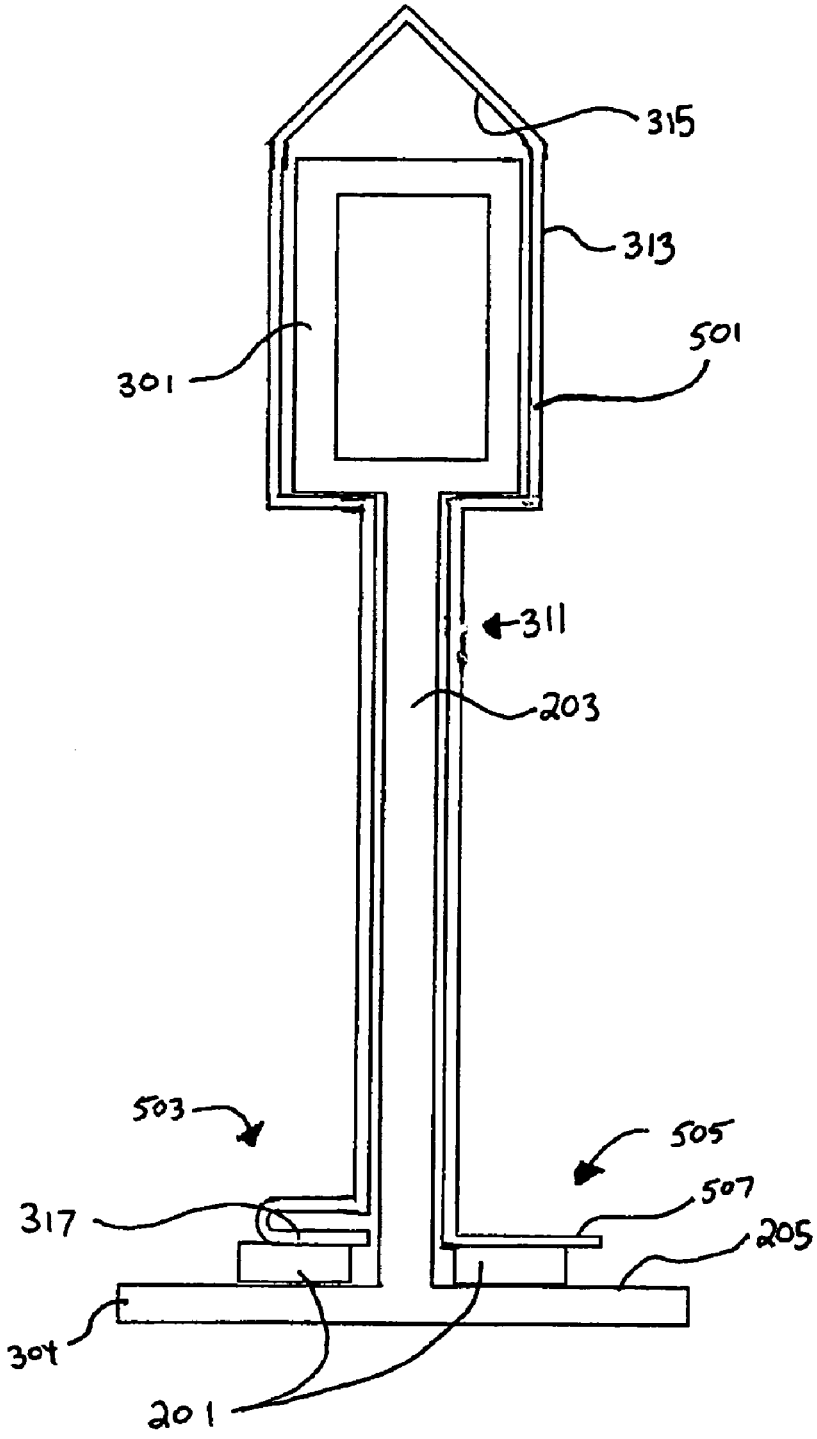
FIG. 10 shows an end elevational view of another embodiment of a support member and connector for installation thereon according to the present invention.

FIG. 10 shows a cutaway elevational view of the support connector 311 shown in FIG. 9 installed on the support member 203. FIG. 10 includes the same arrangement bulb 301, a lower flange surface 205 and conductors 201, outer surface 313, inner surface 315, upper portion 501 and second end 505 as shown and described above with respect to FIG. 6. However, as described with respect to FIG. 9, above, the contact member 317 extends toward and in contact with conductor 201. The connection of the contact member 317 to conductor 201 permits the support connector 311 to provide an electrical connection between conductor 201 adjacent to the first end 503 to the outer surface at end surface 507 at the second end 505.

Figure 11:
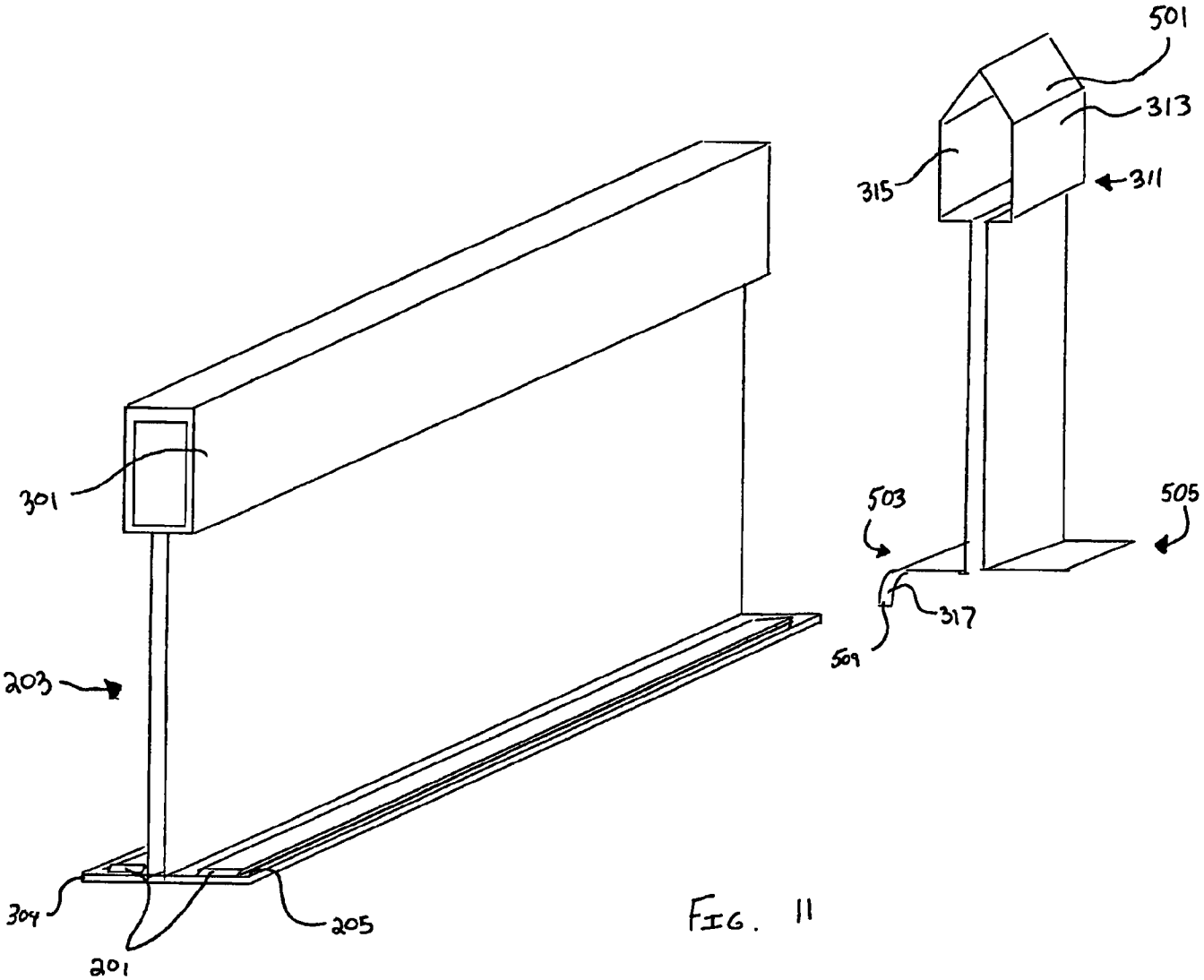
FIG. 11 shows a perspective view of still another embodiment of support member and connector for installation thereon according to the present invention.

FIG. 11 shows a support connector 311 and support member 203 according to an alternate embodiment of the present invention. The support member 203 and support connector 311 includes the same arrangement of bulb 301, a lower flange surface 205 and conductors 201, outer surface 313, inner surface 315, upper portion 501 and second end 505 as shown and described above with respect to FIG. 5. However, the contact member 317 includes a geometry having a protrusion 509 forming an arc extending from the first end 503 of the support connector 311. The protrusion 509 is configured to act as a spring to provide mechanical bias on the conductor 201 when installed onto the support member 203. The elasticity of the material of contact member 317 provides the mechanical bias and allows the contact member 317 to maintain physical contact with the conductor 201. In addition, the geometry preferably provides a sharp point of contact with the conductor 201 to facilitate penetration of any dirt, dust or oxide on the surface of the conductor 201 and to provide good electrical contact between the contact member 317 and the conductor 201. The clipping or clamping action of the upper portion 501 of the support connector 311 may further assist in providing mechanical bias against the conductor 201.

Figure 12:
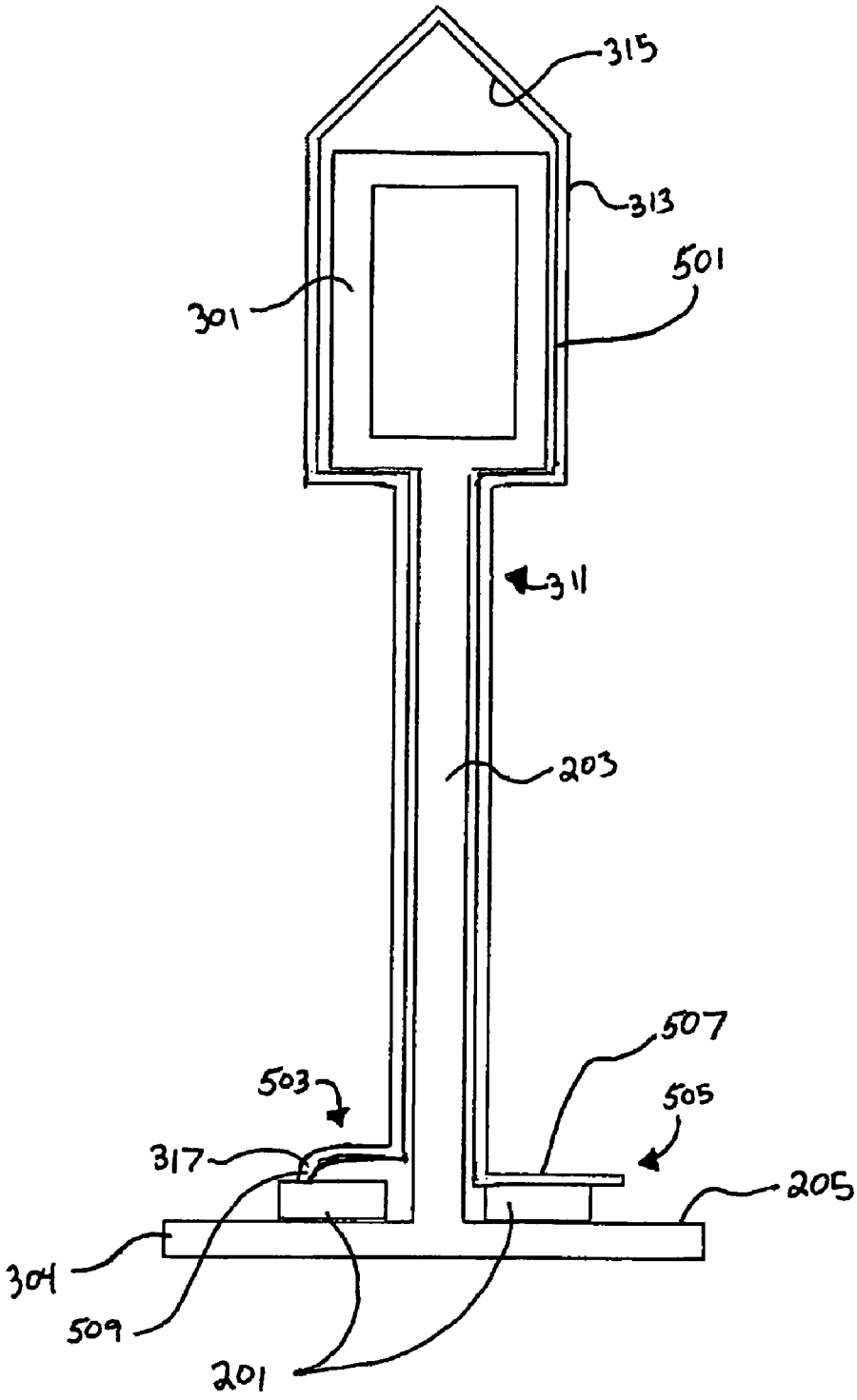
FIG. 12 shows an end elevational view of still another embodiment of a support member and connector for installation thereon according to the present invention.

FIG. 12 shows a cutaway elevational view of the support connector 311 shown in FIG. 11 installed on the support member 203. FIG. 12 includes the same arrangement bulb 301, a lower flange surface 205 and conductors 201, outer surface 313, inner surface 315, upper portion 501 and second end 505 as shown and described above with respect to FIG. 6. However, as described with respect to FIG. 7 above, the protrusion 509 extends from a portion of the first end 503 forming an arc toward and in contact with conductor 201. The connection minimizes the point of contact and increases the force per unit area on the conductor 201 from the contact member 317, allowing for penetration of any dust, dirt or oxide present on the surface of the conductor 201. The connection of the support connector 317 to conductor 201 permits the support connector 317 to provide an electrical connection between conductor 201 adjacent to the first end 503 to the outer surface 313 at the second end 505, end surface 507.

Figure 13:
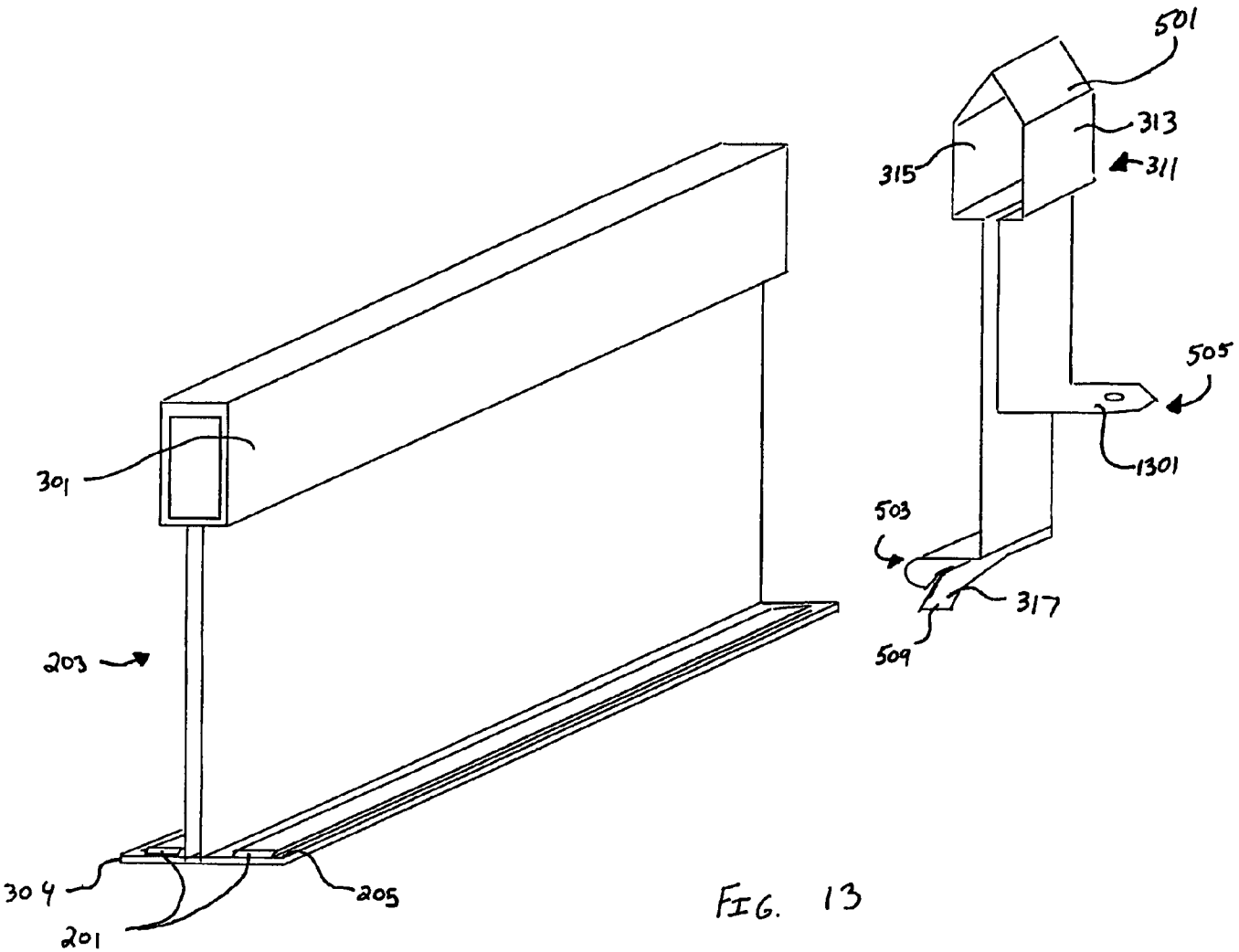
FIG. 13 shows a perspective view of still another embodiment of support member and connector for installation thereon according to the present invention.

FIG. 13 shows a support connector 311 for providing power to the conductors 201 mounted on support member 203 according to an embodiment of the present invention. The support connector 311 provides a connection between conductor 201 and a blade 1301 at second end 505, which is attachable to a power source. The support member 203 and support connector 311 include the same arrangement of bulb 301, a lower flange surface 205 and conductors 201, outer surface 313, inner surface 315, upper portion 501, first end 503, contact member 317 and protrusion 509 as shown and described above with respect to FIG. 5. The contact member 317 is not limited to the geometry shown in FIG. 13, but may include any suitable geometry that provides mechanical bias and electrical contact with the conductor 201, including, but not limited to, the contact members 317 illustrated in FIGS. 7-12 and 16-17. Blade 1301 includes one or more conductive surfaces that are attachable to a power source. Suitable attachment devices include clips, clamps, crimp connections, plugs, screws, solder or any other suitable attachment device. The geometry of blade 1301 is not limited to the geometry shown and may include any geometry that provides conductive surfaces connectable to a power source.

Figure 14:
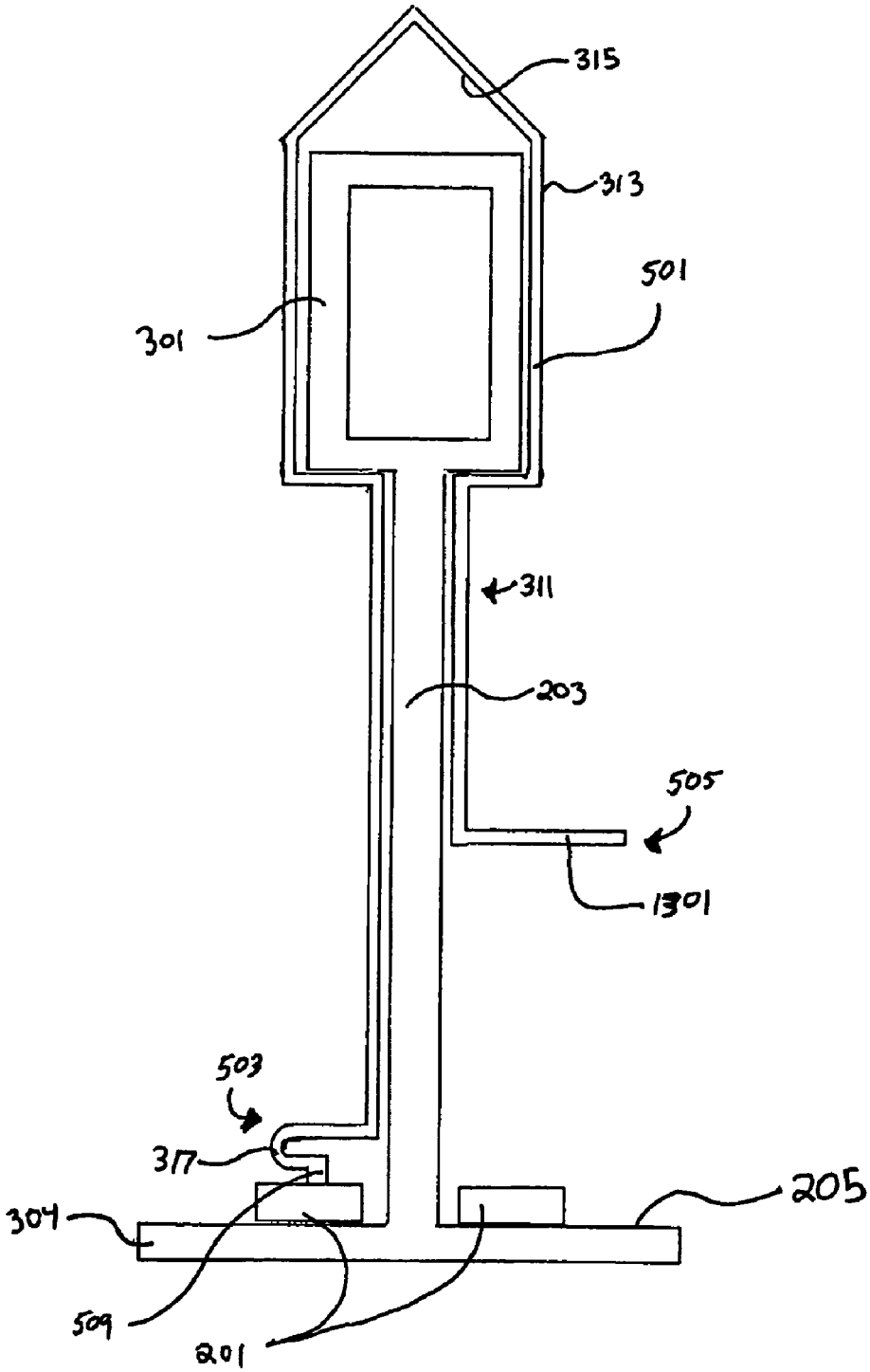
FIG. 14 shows an end elevational view of still another embodiment of a support member and connector for installation thereon according to the present invention.

FIG. 14 shows a cutaway elevational view of the support connector shown in FIG. 13 installed on the support member 203. The support member 203 and support connector 311 include the same arrangement of bulb 301, a lower flange surface 205 and conductors 201, outer surface 313, inner surface 315, upper portion 501, first end 503, contact member 317 and protrusion 509, as shown and described above with respect to FIG. 6. However, as described with respect to FIG. 13 above, the second end 505 includes a blade 1301 that is connectable to a power source. The connection of the blade 1301 at second end 505 to a power source allows the support connector 311 to provide power to conductor 201 via contact member 317 adjacent to the first end 503.

Figure 15:
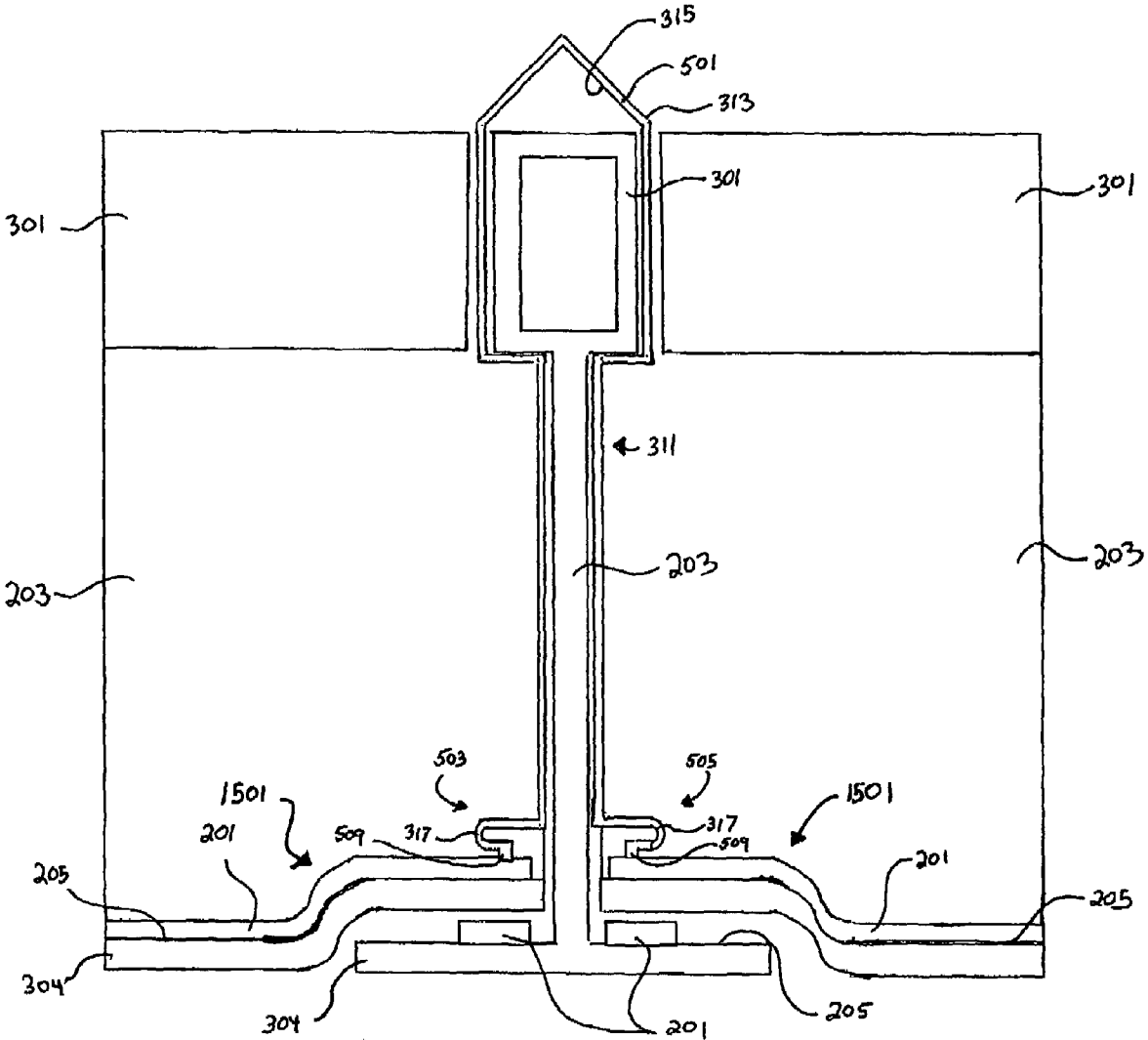
FIG. 15 shows a cross-section of support members viewed from direction 15-15 of FIG. 1.

FIG. 15 shows a cutaway elevational view of an intersection of support members 203 cut along direction 15-15 from FIG. 2 having a support connector 311 disposed to provide power between conductors 201 on disconnected support members 203. The support members 203 have the structure shown and described with respect to FIG. 5. In order to facilitate mating of the transverse support members 203, joggle 1501 permits the intersection of these support members. Joggle 1501 includes portion of flange 304 that is sufficiently raised to mate with the intersecting support member 203. Although FIG. 15 shows a joggle 1501, any suitable arrangement of ceiling support members known in the art for intersecting ceiling support members may be utilized. Support connector 311 bridges between a conductor 201 on a first support member 203 adjacent to the first end 503 and a second transverse support member 203 adjacent to the second end 505. The support connector 311 includes a contact member 317 on each of the first end 503 and the second end 505. The contact members 317 include protrusion 509 and function in the manner shown and described above with respect to FIGS. 5 and 6. The contact members 317 are not limited to the geometry shown in FIG. 15, but may include any suitable geometry that provide mechanical bias and electrical contact with the conductor 201, including, but not limited to the contact members 317 illustrated in FIGS. 7-12 and 16-17. The connection of the contact member 317 at first end 503 to the contact member 317 at second end 505 allows the support connector 311 to provide power from the conductor 201 adjacent to the first end 503 and the conductor 201 adjacent to the second end 505.

In another embodiment of the invention, the support connector 311 may also be installed in a direction opposite the orientation of the support connector 311 shown in FIGS. 5-17 wherein the upper portion 501 is oriented below the support member 203 providing connections between conductors 201 to devices such as power sources, electrical devices, and/or other conductors 201.

In addition to the configurations shown in FIGS. 5-15, the support connector 311 may include connections to conductors 201 disposed in alternate locations, such as in a lower box 303. Further, the support connector 311 may be installed in a configuration such that the support connector 311 passes through openings in the support member 203 or in the lower box 303.

Figure 16:
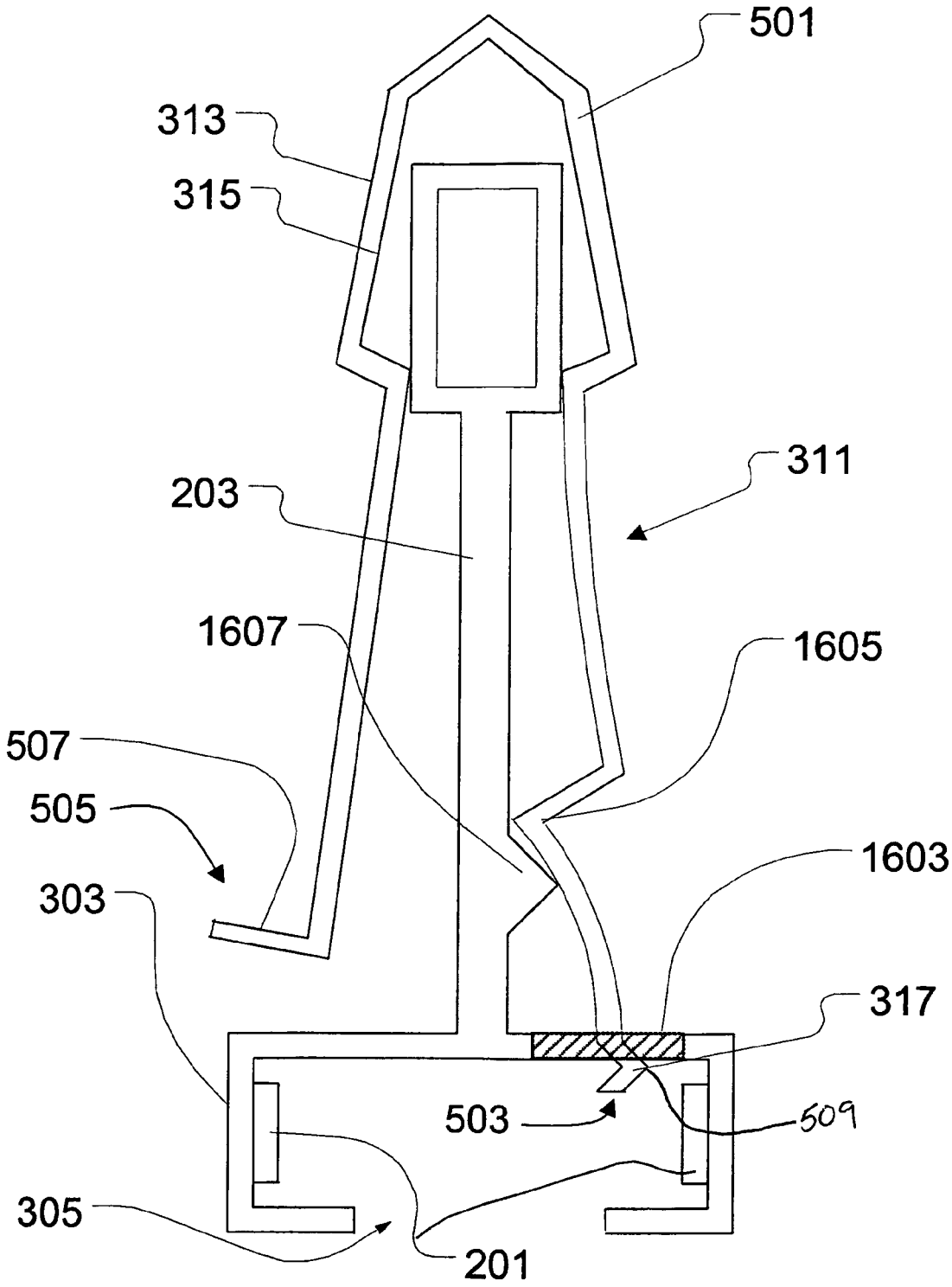
FIG. 16 shows an end elevational view of still another embodiment of a support member and connector in the process of being installed thereon according to the present invention.
Figure 17:
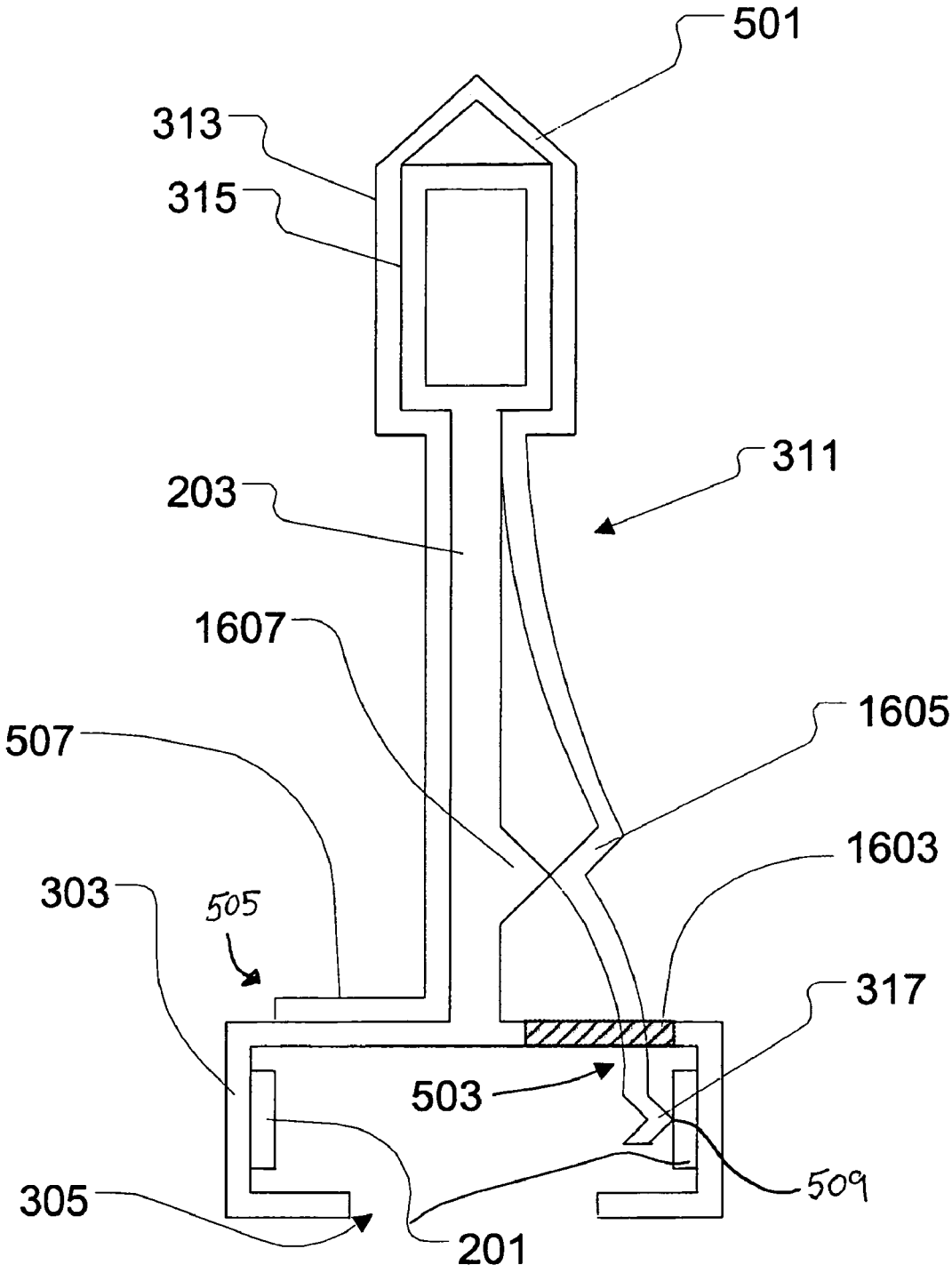
FIG. 17 shows an end elevational view of the connector of FIG. 16 installed on the support member.

FIGS. 16 and 17 illustrate an embodiment of the present invention utilizing a connector 311 that is passed through an opening 1603 to provide electrical contact with conductor 201 disposed in lower box 303. FIG. 16 shows a cutaway elevational view of the support connector 311 in the process of being installed on the support member 203. FIG. 17 shows a cutaway elevational view of support connector 311 installed around support member 203. The support member 203 and support connector 311 in FIGS. 16 and 17 include the same arrangement of bulb 301, a lower box 303, conductors 201, outer surface 313, inner surface 315, contact member 317 and protrusion 509, as shown and described above with respect to FIG. 4. The embodiment shown in FIGS. 16 and 17 includes an upper portion 501, and first end 503, as shown and described with FIG. 5. However, FIG. 16 support connector 311 includes a connector ramp 1605 and a support member ramp 1607 to provide the desired motion of the contact member 317 along the surface of conductor 201. The connector ramp 1605 and support member ramp 1607 are configured to having sloped surfaces that permit the contact member 317 to pass into lower box 303 (see FIG. 16).

As the support connector 311 is installed, the surface of connector ramp 1605 contacts the surface of support member ramp 1607 and the connector is urged in a direction away from the body of the support member 203. The contact member 317 is directed toward conductor 201 (see FIG. 17) by the motion of the connector ramp 1605 against the support member ramp 1607. The motion of the protrusion on the surface of the conductor is preferably a wiping and/or scraping motion sufficient to remove dust, dirt and/or oxide that may be present on the surface of conductor 201. In addition, the contact member 317 preferably includes a mechanical bias. For example, the contact member 317 and protrusion 509 may be configured to act as a spring to provide the mechanical bias via material elasticity on the conductor 201 when installed onto the support member 203. Opening 1603 may be located on any surface of the lower box 303 and may be of any geometry that permits passage of the contact member 317 of support connector 311.

In addition to the alternate configurations, the support connectors 311 may also include geometries and facilitate installation or easy electrical connection. For example, the support connectors 311 may include protrusion from the surface of the support member 203, when installed, that conform to elements connected to the support member 203 or other devices utilized to install the ceiling 103. In addition, the support connectors 311 may include openings, geometries or pre-installed connectors that allow easier installation or easy electrical connections. In addition, contact members 317 may be elongated in order to facilitate electrical conduction between conductors 201 located on adjacent support members 203. Further, multiple contact members 317 on the first end 503 may be utilized to conduct electricity to one or more conductors located on adjacent support members 203.

In another embodiment of the invention, the conductors 201 may be at least partially coated with a material capable of resisting corrosion and dirt or dust. In another embodiment of the invention, the conductor may be embedded into the support member 203. In order to facilitate electrical contact, the coating material of this embodiment of the invention may be electrically conductive or may be pierceable by the contact with the contact member 317 to facilitate contact with the conductor 201.

Figure 18:
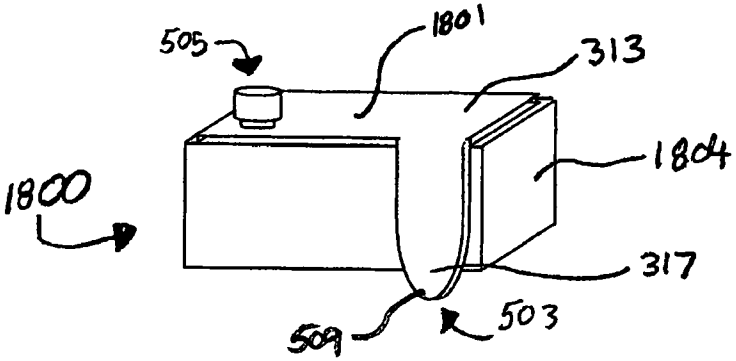
FIG. 18 shows a perspective view of a component connector for installation on a conductive surface according to the present invention.

FIG. 18 shows another embodiment of the present invention including a component connector 1800, having a component connector body 1801 arranged on an insulative housing 1804. Component connector 1800 may be utilized as component connector 309, as shown in FIG. 4, but is not so limited and may be utilized on any conductive surface 1810 and provides electrical terminals for connections to electrical devices. Conductive surface 1810 is a surface that comprises a conductive material and may include the conductive surfaces shown as conductor 201 as shown in FIGS. 3-17 and second end surface 507 in FIGS. 5-12 and 16-17. The component connector body 1801 includes a first end 503 and a second end 505. The component connector body 1801 is also preferably fabricated from a conductive material. Suitable conductive materials may include materials such as aluminum, copper, brass, phosphor bronze, beryllium copper, stainless steel, or other conductive material or combinations thereof. In addition, conductive materials may include a conductive body material having a plating including, but not limited to, nickel, tin, lead, bismuth, silver, gold plating or other conductive material plating or combination thereof. The first end 503 includes a contact member 317 having a protrusion 509 configured to contact a conductive surface 1810, such as a surface of conductor 201 in FIGS. 3-17, or end surface 507 at the second end 505 in FIGS. 5-12 and 16-17, to make electrical contact. The second end 505 includes a terminal capable of connecting the component connector body 1801 to an electrical device, conductive surface or voltage source. Second end 505 may include connections to devices that may or may not be mounted on insulative housing 1804. The connections for use as the second end 505 may include any connector capable of providing electrical contact between the component connector body 1801 and electrical device, conductive surface or voltage source and may include clips, plugs, screws solder or any other known electrical connection.

Figure 19:
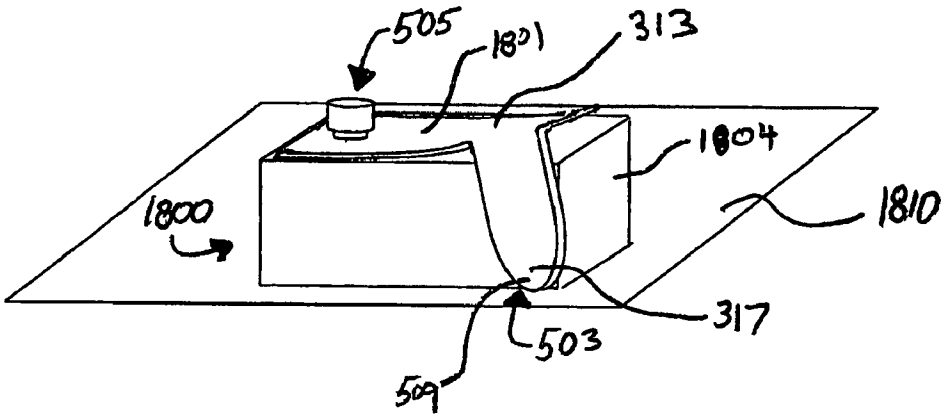
FIG. 19 shows a perspective view of a component connector installed on a conductive surface according to the present invention.

As shown in FIG. 19, the component connector body 1801 includes a mechanical bias, preferably from the material properties of the component connector body 1801 to provide continuous physical contact between the contact member 317 and conductive surface 1800, via elasticity of the material, material memory, by weight of the support connector 311, or by any other force providing means in order to contact and retain contact with the conductive surface 1810. In another embodiment of the invention, the conductive surface 1810 may be configured with a tab or other similar geometry to receive protrusion 509 to assist in providing good electrical contact.

Figure 20:
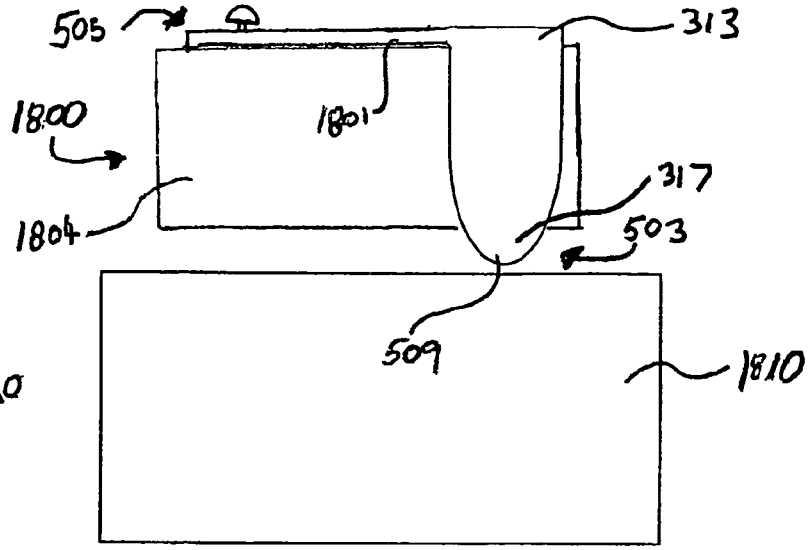
FIG. 20 shows a cross-section of a component connector for installation on a conductive surface according to the present invention.
Figure 21:
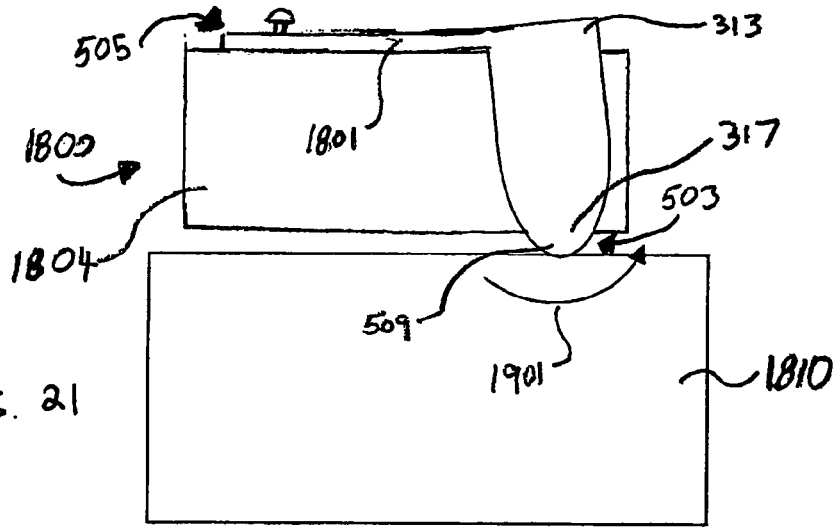
FIG. 21 shows a cross-section of a component connector in the process of being installed on a conductive surface according to the present invention.
Figure 22:
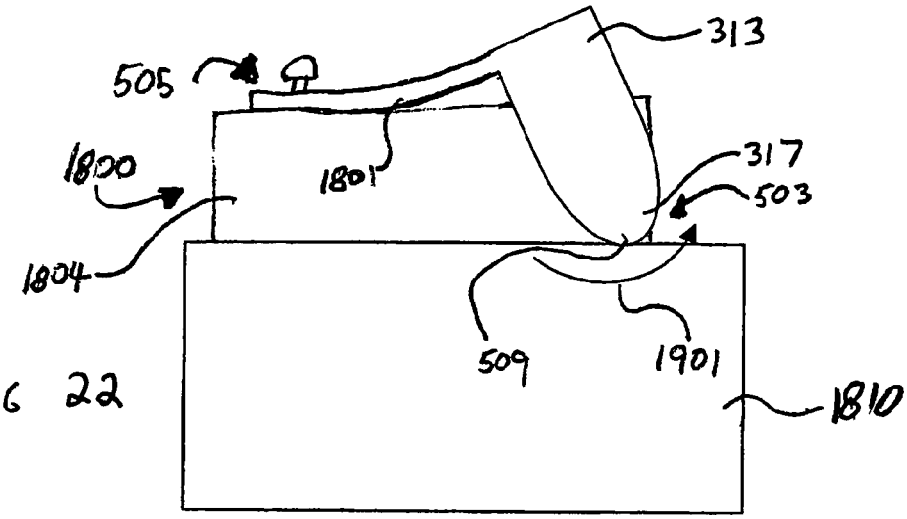
FIG. 22 shows a cross-section of a component connector installed on a conductive surface according to the present invention.

FIGS. 20-22 show the operation of the component connector body 1801 when the component connector 1800 is installed. As shown in FIG. 20, the component connector 1800 includes protrusion 509 extending away from the insulative body 1804. As shown in FIG. 21, the component connector body 1801 begins to deflect in direction 1901 upon contact of protrusion 509 with the conductive surface 1810. The mechanical bias provides a force per unit area that maintains physical and electrical contact with conductive surface 1810. FIG. 20 shows the component connector 1800 having insulative body 1804 resting adjacent to the conductive surface 1810 with the component connector body 1801 deflected in direction 1901. The movement of the direction 1901 includes a wiping motion that infiltrates and/or wipes any dirt, dust or oxide that may be present on conductive surface 1810 in order to provide sufficient electrical contact.

The arrangement of the component connector body 1801 and the insulative body 1804 is not limited to the arrangement shown in FIGS. 18-22. For example, the contact member 317 may include geometries, such as those geometries of contact member 317 shown in FIGS. 3-17 or any other geometry that provides sufficient electrical and physical contact via mechanical bias of the component connector body 1801. In preferred embodiment, the contact member 317 includes a protrusion 509 having a geometry that permits rotation, such as the rotation in direction 1901 shown in FIGS. 20-22. The rotation preferably provides a wiping motion that facilitates at least partial removal of dirt, dust or oxide that may be present on the conductive surface.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electrified ceiling system comprising:

a ceiling supported by a ceiling grid framework, the ceiling grid framework having a plurality of support members, wherein at least one support member has a vertical surface;

first and second conductive materials having opposing polarities, the first and second conductive materials being electrically isolated from one another and mounted on at least one of the plurality of support members, wherein the first and second conductive materials are mounted on opposing sides of the vertical surface of the at least one support member;

a connector having a conductive body having a first end and second end, the first and second ends being positioned on opposing sides of the vertical surface of the at least one support member;

the first end being arranged and disposed to provide selective electrical contact to the first conductive material;

the first end comprising a conductive, mechanically biased member capable of maintaining physical contact with the first conductive material;

the second end comprising a surface arranged and disposed adjacent the second conductive material, the second end providing selective electrical contact to a device selected from the group consisting of a power source, a third conductive material, an electrical device and combinations thereof; and wherein the conductive body provides electrical connectivity between the first conductive material and the device.

2. The electrified ceiling system of claim 1, wherein the conductive body comprises a material selected from the group consisting of aluminum, copper, brass, phosphor bronze, beryllium copper, stainless steel, and combinations thereof.

3. The electrified ceiling system of claim 1, wherein the conductive body comprises a plating selected from the group consisting of nickel, tin, lead, bismuth, silver, gold plating and combinations thereof.

4. The electrified ceiling system of claim 1, wherein one of the first and second ends of the conductive body further comprises a substantially horizontal surface.

5. The electrified ceiling system of claim 1, wherein one of the first and second ends includes a conductive, mechanically biased member capable of maintaining physical contact with one of the first and second conductive materials.

6. The electrified ceiling system of claim 1, wherein the conductive body extends through openings in the ceiling framework.

7. The electrified ceiling system of claim 1, wherein at least a portion of the mechanical bias is from the clipping of an upper portion of the connector.

8. The electrified ceiling system of claim 1, wherein at least a portion of the mechanical bias is from the material properties of the mechanically biased member.

9. The electrified ceiling system of claim 1, wherein at least a portion of one of the first and second conductive materials is coated.

10. The electrified ceiling system of claim 1, wherein the conductive body further comprises an insulative coating.

11. The electrified ceiling system of claim 10 wherein the insulative coating comprises a material selected from the group consisting of polyester, acrylic, polyurethane, polyvinyl, silicone, epoxy and combinations thereof.

* * * * *